United States Patent [19]

Bast et al.

[11] 4,365,140

[45] Dec. 21, 1982

[54] THERMOSTATICALLY CONTROLLED DUAL TEMPERATURE ELECTRIC HAIR CURLING IRON

[75] Inventors: Eleanor A. Bast, West Chicago; Jean-Pierre DuBois, Lombard; Robert T. MacLagen, Park Forest, all of, IL

[73] Assignee: Sunbeam Corporation, Chicago, Ill.

[21] Appl. No.: 167,867

[22] Filed: Jul. 14, 1980

[51] Int. Cl.[3] ..... H05B 1/02; A45D 1/04

[52] U.S. Cl. ..... 219/225; 132/9; 132/11 R; 132/33 R; 132/37 R; 219/240; 219/241; 219/508

[58] Field of Search ..... 219/222–225, 219/241, 508, 240, 533; 132/37 R, 37A, 118, 31 R, 11 R, 7, 9, 33 R

[56] References Cited

U.S. PATENT DOCUMENTS

| | | | |
|---|---|---|---|
| 563,784 | 7/1896 | Morley . | |
| 1,759,265 | 5/1930 | Kunin et al. . | |
| 2,239,119 | 4/1941 | Rutledge | 132/34 R |
| 2,448,263 | 8/1948 | Hannon | 132/34 R |
| 2,544,326 | 3/1951 | Jones | 219/241 X |
| 2,619,576 | 11/1952 | Greibach | 219/240 |
| 2,785,689 | 3/1957 | Trabish | 132/34 R |
| 3,102,941 | 9/1963 | Pope . | |
| 3,610,878 | 10/1971 | Thomas et al. | 219/222 |
| 3,839,622 | 10/1974 | Mastin | 219/508 X |
| 3,889,097 | 6/1975 | Forsberg | 219/242 |
| 4,074,110 | 2/1978 | Slaughter | 219/240 |
| 4,151,401 | 4/1979 | Van Bokestal et al. | 219/508 |
| 4,211,914 | 7/1980 | Jackson | 219/225 |

FOREIGN PATENT DOCUMENTS

| | | | |
|---|---|---|---|
| 650058 | 2/1951 | United Kingdom . | |
| 671272 | 4/1952 | United Kingdom . | |
| 693934 | 7/1953 | United Kingdom . | |
| 749492 | 5/1956 | United Kingdom . | |
| 760296 | 10/1956 | United Kingdom . | |
| 1188450 | 4/1970 | United Kingdom . | |
| 1358562 | 7/1974 | United Kingdom . | |
| 1470769 | 4/1977 | United Kingdom | 219/240 |
| 1498763 | 1/1978 | United Kingdom . | |
| 1532016 | 11/1978 | United Kingdom . | |
| 1553290 | 9/1979 | United Kingdom . | |
| 2022406 | 12/1979 | United Kingdom . | |

*Primary Examiner*—A. Bartis

*Attorney, Agent, or Firm*—George R. Clark; Neil M. Rose; Robert J. Fox

[57] ABSTRACT

A dual temperature electric hair curling iron has a barrel rotatable relative to a rigid handle by means of a friction clutch therebetween. The barrel includes a plurality of apertures allowing steam or mist generated within the barrel to flow into contact with the hair being curled. An electric heater in the barrel is controlled by a low limit (220° F.) thermostat and a high limit (270° F.) thermostat located within the barrel. A normally open momentary contact switch manually operated by a ring-like arm encompassing the a front portion of the handle is arranged in circuit with the thermostats and heater in such a manner that the low limit thermostat controls the temperature of the barrel when the switch is in its normal open position. Closing of the switch by movement of the arm relative to the handle disables the low limit thermostat and allows the barrel temperature to increase to the limit set by the high limit thermostat thereby allowing tighter curls to be produced. The arm is spring-biased so that the switch is automatically returned to the normally open position when the arm is released, thus providing fail-safe operation of the iron under control of the low limit thermostat.

4 Claims, 7 Drawing Figures

THERMOSTATICALLY CONTROLLED DUAL TEMPERATURE ELECTRIC HAIR CURLING IRON

BACKGROUND OF THE INVENTION

Curling irons have been and continue to be popular personal care appliances. However, the prior art curling irons suffer from several drawbacks. In most cases, the barrel around which the user's hair is wrapped for curling is fixed with respect to the handle requiring the user to rotate the handle as the hair is being wound around the barrel.

The amount or tightness of curl which can be set in the user's hair is, in part, dependent upon the temperature of the barrel of the curling iron. A relatively high temperature barrel will provide the user with tighter curls than a relatively low temperature barrel. It is clear though that for nearly all uses of the curling iron, only a relatively low temperature is required.

SUMMARY OF THE INVENTION

A curling iron having a rigid handle is disclosed herein. A rotatable barrel is fitted to the rigid handle for rotation relative thereto. The barrel includes a plurality of apertures which allow heated mist generated by a wick and heater arrangement to flow outward from the barrel and into contact with a user's hair.

Electric power is drawn from a conventional alternating current power source through a cord and is supplied to a rope resistance heater located interiorly of the rotatable barrel. A low limit thermostat and a high limit thermostat are electrically connected to the heater and located in good heat transfer relationship with the rotatable barrel. A normally open momentary contact switch having a ringlike switch arm encompassing a portion of the handle is connected in circuit with the heater and the thermostats. Normally, the contact switch is open allowing the temperature of the rotatable barrel to be controlled by the low limit thermostat. When the user desires, she may move the switch arm rearwardly along the handle to close the momentary contact switch and shunt around the low limit thermostat. This allows the barrel temperature to increase until it reaches the opening temperature of the high limit thermostat. In this embodiment, the low limit thermostat opens at 220° F. and the high limit thermostat opens at 270° F.

The high limit thermostat is only enabled when the user wishes to have relatively tightly curled hair. The curling iron has a fail-safe feature in that when the user is not operating the unit, although it may be plugged in, the low limit thermostat controls the barrel temperature.

It is a principal object of the present invention to provide a curling iron having a manually controllable temperature set point.

It is another object of the instant invention to provide a curling iron having a first low temperature thermostat and a second high temperature thermostat, only one of said thermostats being enabled by a user-controlled handle-mounted switch.

Another object of the present invention is to provide a curling iron having an exterior barrel rotatable with respect to a rigid handle.

Other objects of this invention will become obvious to those skilled in the art upon a perusal of the specification and claims in light of the drawings.

DESCRIPTION OF THE PREFERRED EMBODIMENT

Figures 1, 2, 3, 4, 5:
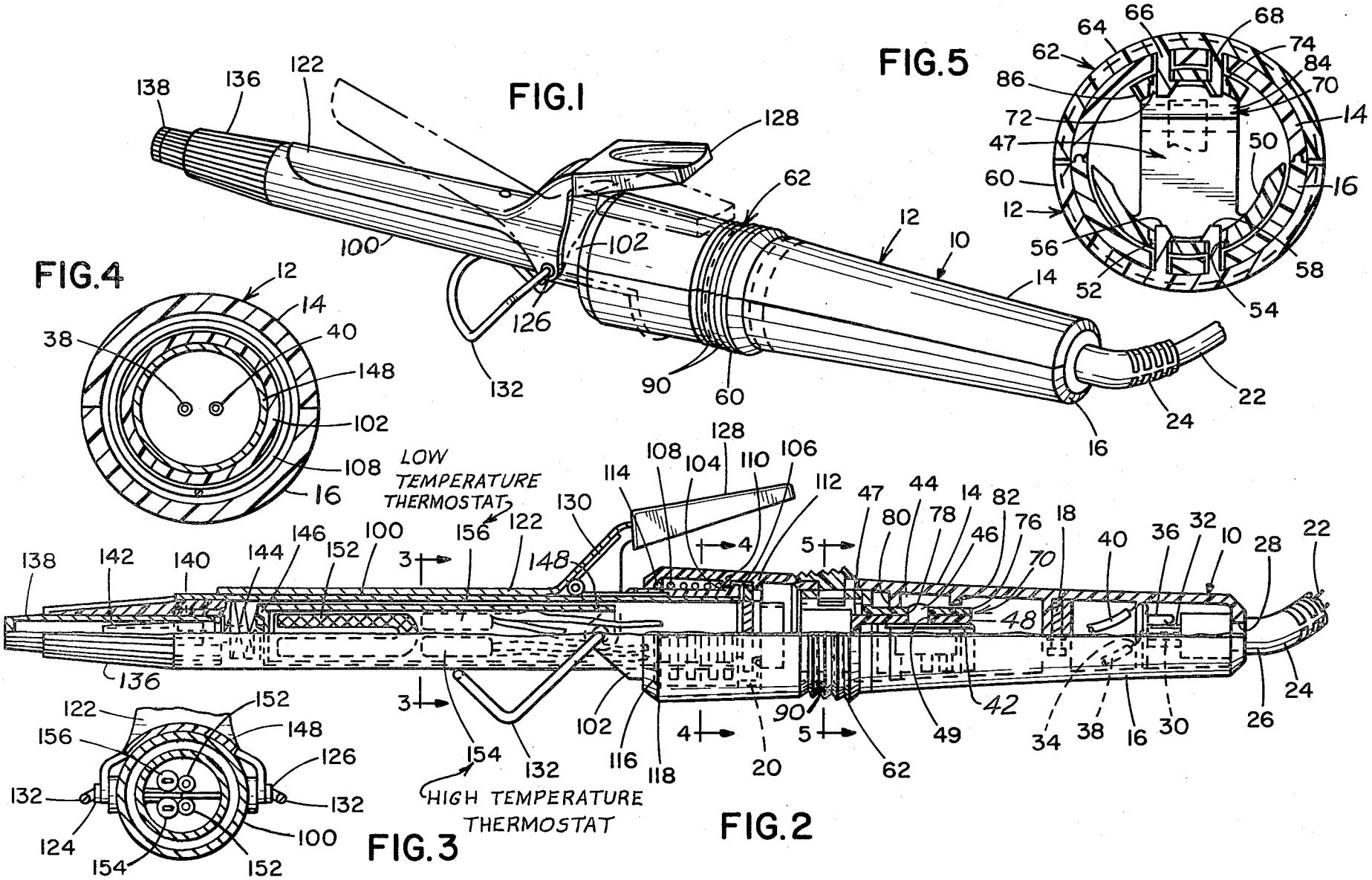
FIG. 1 is a perspective view of a curling iron embodying the present invention showing the retaining arm in a raised position in phantom and showing a ring stand in a collapsed position in phantom.
FIG. 2 is a side elevational view of the curling iron with the upper half thereof generally in vertical section to better show details of its internal construction.
FIG. 3 is an enlarged transverse sectional view taken generally along line 3—3 of FIG. 2 showing details of the orientation of a rope heating element and a pair of thermostats located within a barrel.
FIG. 4 is an enlarged transverse sectional view taken generally along line 4—4 of FIG. 2 showing details of the arrangement of a spring loaded frictional clutch provided between the rotatably mounted exterior barrel and the handle.
FIG. 5 is an enlarged transverse sectional view taken generally along line 5—5 of FIG. 2 showing details of the arrangement of a switch arm and momentary contact switch.
Figure 6:
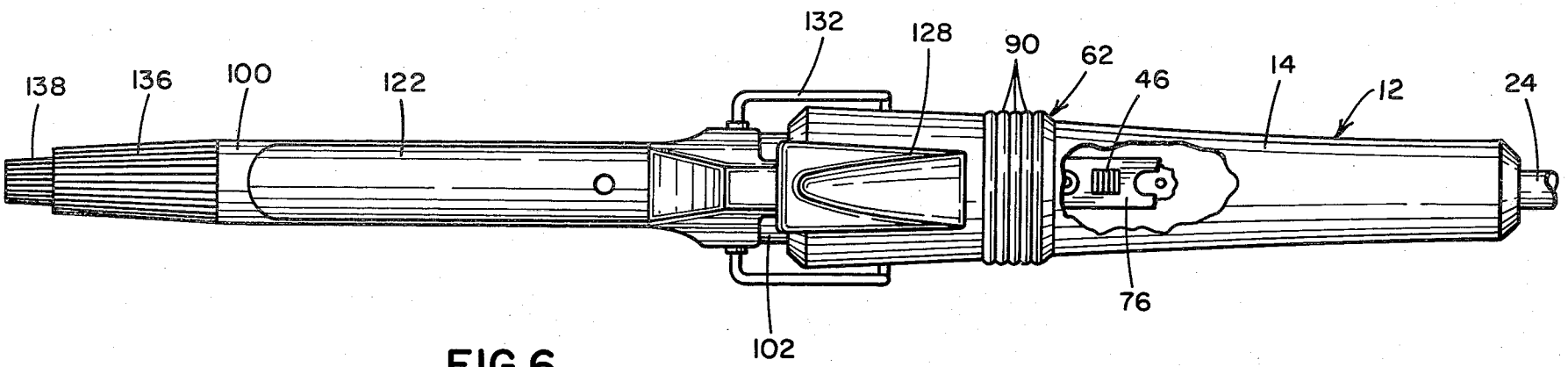
FIG. 6 is a top plan view of the curling iron having a portion broken away to show details of the mechanical connection between the switch arm and the momentary contact switch.
Figure 7:
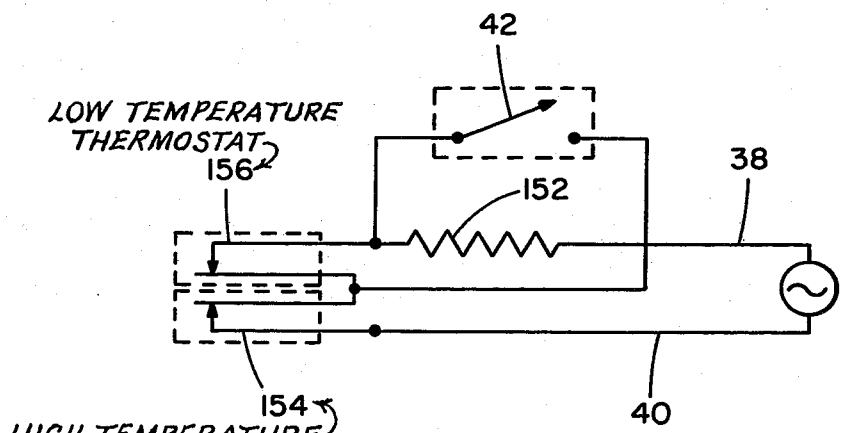
FIG. 7 is a schematic diagram of the electrical connections between the thermostats, the rope resistance heater and the momentary contact switch.

FIGS. 1 and 2 show a curling iron generally referred to by numeral 10 therein. Curling iron 10 has a symmetric handle 12 comprised of substantially identical upper and lower portions 14 and 16. Handle portions 14 and 16 are connected together by a pair of threaded fasteners respectively numbered 18 and 20, as is conventional in the art.

A power cord 22 for connection to a suitable source of alternating current is received by an angular strain relief 24. In order to allow the user to easily rotate the handle of the curling iron, for instance, while winding or unwinding hair around a barrel, strain relief 24 forms a portion of a swivel connector 26, which is rotatably received at an end aperture 28 of handle 12. Swivel connector 26 has a center pin contact 30 and a cylindrical barrel 32 located concentrically about pin 30 and insulted therefrom. Line potential present across pin 30 and cylinder 32 when the curling iron is plugged in is transferred to a pin receiving connector 34, which is in connection with pin 30, and a brush 36, which is in connection with cylinder 32. This construction in curling irons and other small appliances is well known to those skilled in the art.

Referring now specifically to FIG. 2, a pair of leads, respectively numbered 38 and 40, are connected to contacts 34 and 36 whereby to conduct power therefrom to an interior portion of a barrel, as will be explained in detail hereinafter. A spring loaded momentary contact slide switch 42 is mounted interiorly of handle 12 and, as will be described in detail hereinafter, is connected in a circuit with both a high limit thermostat and a low limit thermostat whereby to allow a user to select the barrel temperature of the curling iron 10.

Momentary contact switch 42 is received in a cradle 44 so that only a toggle 46 of switch 42 is movable with respect to handle 12. A lower switch arcuate slide 47 having a flat, rectangular portion 48 with rectangular aperture 49 formed therein is fitted in engagement with switch 42 so that toggle 46 is snugly received by aperture 49. An arcuate slide 50 is formed integral with rectangular section 48 and is disposed in sliding proximity with an interior portion of handle 12. Arcuate portion 50 includes a pair of slots 52 and 54 adapted to receive a pair of tapered lock members 56 and 58, which are formed integral with a lower semicircular half 60 of an annular switch arm 62. Switch arm 62 also includes an upper semicircular portion 64, which has a pair of lock members 66 and 68 formed integral therewith and which are lockingly received by an upper switch slide 70 through a pair of slots respectively numbered 72 and 74. Upper slide 70 has a rectangular portion 76 with a rectangular aperture 78 formed therein for receipt of switch toggle 46. Slide 70 rides against a pair of handle retaining ribs 80 and 82 which provide alignment for the switch assembly. Slide 70 is formed integral with an upright 84, which, in turn, is formed integral with an arcuate portion 86, which is in sliding proximity with the interior of handle 12. Switch arm 62 has a plurality of exterior, circular ribs 90 formed therein to assist a user who may have wet and slippery hands in maintaining a grip on the switch arm in order to move the arm against the bias of switch 42. When the switch arm 62 is moved toward end 29 of the handle, ribs 80 and 82 prevent a torque from being applied to the toggle 46 and jamming switch 42. This allows the user to apply the retracting force to switch arm 62 from any point about the annular arm. Movement of switch arm 62 rearwardly causes the barrel of the curling iron to increase in temperature for the period that the arm is retracted, as will be explained hereinafter.

In order to provide additional convenience for the user of the curling iron, the unit has a rotatable exterior barrel 100, which is received in a vinyl sleeve 102 mounted in the forward end of the handle 12. Sleeve 102 terminates at a pair of lands 104 and 106. Land 104 is engaged by a helical compression spring 108. Land 106 is seated between a pair of interior flanges 110 and 112 formed integral with the interior of the handle portion 14 forward of switch arm 62. Helical spring 108 also engages a longitudinally movable flat, metal retaining ring 114, which is seated in frictional engagement with a flange 116 of a forward end 118 of handle 12. Spring 108 provides a bias between land 106 and end 118, which prevents inadvertent rotation of barrel 100 with respect to rigid handle 12.

Barrel 100 has a plurality of mist apertures, not shown herein, positioned beneath a pivoting hair retaining clip 122 to provide heated moisture to the user's hair in a manner that is well-known in the art. Pivoting clip 122 is connected to barrel 100 at a pair of pivot points 124 and 126. An insulated handle 128 is fitted to clip 122 for the convenience of the user. Clip 122 is normally biased against barrel 100 by a spring 130. A ring stand 132 is fitted to barrel 100 at clip pivot points 124 and 126 to allow the user to set the heated curling iron down without allowing barrel 100 to touch the surface upon which curling iron 10 rests. Ring stand 132 is pivotable against handle 12 in use, as shown by broken lines in FIG. 1.

In order to assist the user in grasing and rotating barrel 100 with respect to handle 12, a tapered ribbed nose or cool tip 136 is mounted on an end of barrel 100. A hollow plunger 138 movable longitudinally with respect to barrel 100 is partially received within ribbed nose 136. Plunger 138 is threadingly connected to a plunger seat 140 which has a wick 142 mounted therein for absorption of water contained within plunger 138. A wick biasing spring 144 holds plunger 138 in a normally extended position. When a user wants additional mist or heated vapor from the curling iron 10, plunger 138 is depressed, bringing the moistened end of wick 142 against a heat sink end 146 of an interior barrel 148. Interior barrel 148 is heated, as will be hereinafter explained.

Although exterior barrel 100 is rotatable with respect to handle 12, interior barrel 148 is nonrotatably fixed with respect to handle 12, thereby eliminating the necessity of providing rotatable electrical connections between leads 38 and 40 and a rope heater 152 connected to lead 38 and a high limit thermostat 154 connected to lead 40. A low temperature limit thermostat 156 is connected between rope resistance heater 152 and high temperature thermostat 154. Momentary contact switch 42 is also connected between heater 152 and high temperature thermostat 154 in parallel with low temperature thermostat 156. In the present embodiment, applicants have chosen low temperature thermostat 156 to have an opening temperature of 22020 F. High temperature thermostat 154, in the present embodiment, has an opening temperature of 270° F. Barrel 100 is heated by heat transfer from barrel 148 and rope heater 152. Heater 152 is energized by plugging cord 22 into a suitable wall outlet. Barrel 100 is allowed to heat until it reaches a temperature of 220° F. where thermostat 156 opens and proceeds to cycle open and closed to hold barrel 100 at 220° F. For most uses, this temperature proves sufficient. However, if a user desires to have a slightly longer lasting set or tighter curls, the user may pull switch arm 62 toward the rear handle 12 closing switch 42 and shunting current around low temperature thermostat 156. This, in effect, enables high temperature thermostat 154, which remains closed until a barrel temperature of 270° F. is reached. At that point, high temperature thermostat 154 begins cycling in a well-known fashion to maintain the temperature of barrel 100 at 270° F. Barrel 100 will remain at the higher temperature until switch 42 is allowed to open by releasing switch arm 62. When switch 42 is allowed to open, current is interrupted to heater 152 since low temperature thermostat 156 is open due to the barrel temperature exceeding 220° F. The barrel then cools to 220° F. and thermostat 156 again cycles open and closed to control the temperature of heater 152 in a well known fashion.

It may be appreciated that the major advantage of curling iron 10 lies in the low and high temperature thermostats 156 and 154 both located within interior barrel 148 to control the temperature of exterior barrel 100. High temperature thermostat 154 is enabled by the user when the user activates switch 42 by pulling back on switch ring 62. Since switch ring 62 is ribbed and circular, switch 42 may be easily activated by the user irrespective of the rotational orientation of handle 12.

Since the user may find it desirable to hold handle 12 fixed in her hand, particularly when switch 62 is activated, barrel 100 may be easily rotated by applying a torque to the ribbed cool tip 136 to wind or unwind the user's hair about barrel 100 in the conventional fashion. The use of swivel connector 26 is an additional convenience for the user in that it prevents the power cord from becoming twisted and tangled during use.

While a single embodiment of the present invention has been shown and described, it will be apparent to those skilled in the art that various changes and modifications may be made without departing from the invention in its broader aspects, and it is, therefore, contemplated in the appended claims to cover all such changes and modifications as fall within the true spirit and scope of the present invention.

What is claimed as new and desired to be secured by Letters Patent of the United States is:

1. A curling iron comprising means for connection to a source of electric power, a handle, a barrel connected to said handle, a heater disposed in good heat transfer relation to said barrel, a first temperature controller connected in circuit with said heater and said connection means and disposed in good heat transfer relation to said barrel for controlling a flow of electric power from said connection means to said heater to regulate the temperature of said barrel to a first predetermined temperature, a second temperature controller connected in circuit with said heater and said connection means and disposed in good heat transfer relation to said barrel for controlling a flow of electric power from said connection means to said heater to regulate the temperature of said barrel to a second predetermined temperature, which is substantially higher than said first predetermined temperature, switch means for disabling said first temperature controller and enabling said second temperature controller to effect a change in the temperature of said barrel, said switch means including a manually operable means mounted on said handle for moving said switch means from a first position wherein said first temperature controller is enabled to a second position wherein said first temperature controller is disabled and said second temperature controller is enabled, and biasing means normally urging said manually operable means and said switch means to a position in which said first temperature controller is enabled.

2. The curling iron of claim 1 wherein said switch means includes a manually operable means mounted on said handle.

3. The curling iron of claim 1 wherein said manually operable means comprises a ring-like member surrounding said handle and displaceable against said biasing means to cause said temperature controlling means to control said barrel to said second temperature control point.

4. A curling iron comprising an electric cord for connection to a source of electric power, a substantially cylindrical rigid handle having one end receiving said electric cord at a swivel connector, an outer barrel rotatably mounted on another end of said handle opposite said swivel connector and having an insulating end rib connected thereto, an electric heater connected to said electric cord for receipt of electric power to be heated thereby, said heater being disposed in good heat transfer relation to an inner barrel that is fixed to said rigid handle, said inner barrel being proximally and concentrically disposed with respect to said outer barrel, a first thermostat electrically connected with said heater and disposed in good heat transfer relation to said barrels for controlling a flow of electric power from said electric cord to said heater and interrupting said flow of said electric power when said barrels exceed a first predetermined temperature, a second thermostat electrically connected with said heater and disposed in good heat transfer relation to said barrels for controlling a flow of electric power from said electric cord to said heater and interrupting said flow of said electric power when said barrels exceed a second predetermined temperature that is higher than the first predetermined temperature, and a spring biased switch having a circular annular switch arm actuator disposed about said handle, said switch being connected to said thermostats and said heater and being normally biased to enable said first thermostat and disable said second thermostat and said switch disabling said first thermostat and enabling said second thermostat when said actuator is moved against the spring bias of said switch.

* * * * *